United States Patent [19]

Stoesser

[11] 4,029,242

[45] June 14, 1977

[54] LEG HOLSTER

[76] Inventor: Martin J. Stoesser, 2407 Springdale Rd., Apt. 7C, Waukesha, Wis. 53186

[22] Filed: Dec. 21, 1973

[21] Appl. No.: 427,229

[52] U.S. Cl. ..... 224/2 B; 224/26 K

[51] Int. Cl.[2] ..... F41C 33/02

[58] Field of Search ..... 224/2 B, 5 R, 26 F, 224/5 A, 5 H, 26 K, 26 D, 28 B, 2 C, 2 D, 2 E, 2 F, 26 R, 1 R

[56] References Cited

UNITED STATES PATENTS

| | | | |
|---|---|---|---|
| 781,056 | 1/1905 | Duncan | 224/26 F |
| 1,287,875 | 12/1918 | Careless | 224/26 F |
| 1,382,446 | 6/1921 | Warren | 224/26 F |
| 2,819,830 | 1/1958 | Murray | 224/2 B |
| 2,870,502 | 1/1959 | Sasse | 24/208 R X |
| 3,322,311 | 7/1967 | Homer | 224/5 R |

OTHER PUBLICATIONS

Legace Ankle Holster, R. & N. Simons (Distributor), 10960 Church Street, Chicago, Illinois.

*Primary Examiner*—Robert J. Spar
*Assistant Examiner*—Jerold M. Forsberg
*Attorney, Agent, or Firm*—Andrus, Sceales, Starke & Sawall

[57] ABSTRACT

A hand gun securing apparatus provides a holster fixedly connected to a first leg encircling member preferably located slightly above an ankle bone and a stabilizing member including a second leg encircling member preferably located at or above a calf and below a knee bone which further includes a downwardly extending member which is releasably and pivotally connected to the holster.

13 Claims, 3 Drawing Figures

LEG HOLSTER

BACKGROUND OF THE INVENTION

This invention relates to a hand gun securing apparatus wherein a holster is releasably secured to a human leg.

Weapons such as hand guns have been attached to various parts of the human body and have generally been positioned to be readily removed by the wearer or to be completely concealed from view.

One form of hand gun securing apparatus utilizes a belt or strap which is connected to a holster and is placed about a wearer's waist or thigh and frequently utilizes a tether or tie string connected to a lower portion of the holster and secured about the leg.

Various pouches have been attached or connected to a human leg to be concealed, with one known pouch providing a pair of elastic bands securely connected directly to a flexible pouch structure which is preferably held against the leg shin, such as shown in U.S. Pat. No. 3,322,311. Such pouches have been designed to carry pens, cigarettes, pipes, tobacco pouches, combs, money paper and such articles but would not comfortably and securely hold and retain a bulky and heavy item such as a hand gun which is capable of severly irritating the wearer if improperly carried.

SUMMARY OF THE INVENTION

This invention relates to an apparatus for removably securing a hand gun to a human leg.

The hand gun securing apparatus of the invention provides a first securing member including a holster connected to a first leg encircling member. A second leg encircling member is spaced from the holster while a connector assembly is coupled to the first securing member and to the second leg encircling member for securing and stabilizing the hand gun to the human leg.

The second leg encircling member together with the connector assembly operates to provide a highly desirable stabilizing member which is capable of being selectively adjusted so that the hand gun may be comfortably worn in a highly secured manner.

The connector assembly preferably includes a laterally extending member fixedly connected to the upper leg encircling member to provide an outer end portion which is substantially perpendicular thereto. A plurality of latch elements are connected to the outer end of the laterally extending member and selectively and releasably engage a latching element located at the upper portion of the holster. The selective and releasable connection provided between the laterally extending portion and the holster permits the distance between the upper and lower leg encircling members to be properly adjusted. In addition, the connector assembly permits pivotal movement between the laterally extending portion and the holster in a highly unique and desirable manner. The selective connection of a single snap provides a highly desirable, releasable and pivotal connection between the laterally extending member and the holster in a preferred embodiment.

The first leg encircling member provides a plurality of spaced latching elements, such as snaps, at opposite ends thereof with the elements at one end adapted to securely and releasably engage the elements of the opposite end so that the first leg encircling member may be adjustably secured about the ankle slightly above the ankle bone.

The second leg encircling member also provides a plurality of similar type latching elements, such as snaps, at opposite ends which are selectively and releasably engaged to provide an adjustable assembly. The second leg encircling member is preferably located slightly below the knee cap and at or slightly above the calf.

The two leg encircling members are preferably made from an elastic band having longitudinal stretch although many other types of materials could be utilized within the scope of applicant's invention.

The holster is fixedly connected to the first leg encircling member so that the longitudinal axis of the holster forms an acute angle with a plane formed by the first leg encircling member.

Applicant has therefore provided a highly desirable hand gun securing apparatus which is readily adjustable so that a wearer may conveniently conceal the heavy and bulky weapon with a high degree of comfort.

BRIEF DESCRIPTION OF THE DRAWINGS

The drawing furnished herewith illustrates the best mode presently contemplated by the inventor and clearly discloses the above advantages and features as well as others which will be readily understood from the detailed description thereof.

In the drawings.

DESCRIPTION OF THE PREFERRED ILLUSTRATED EMBODIMENT

Figure 1:
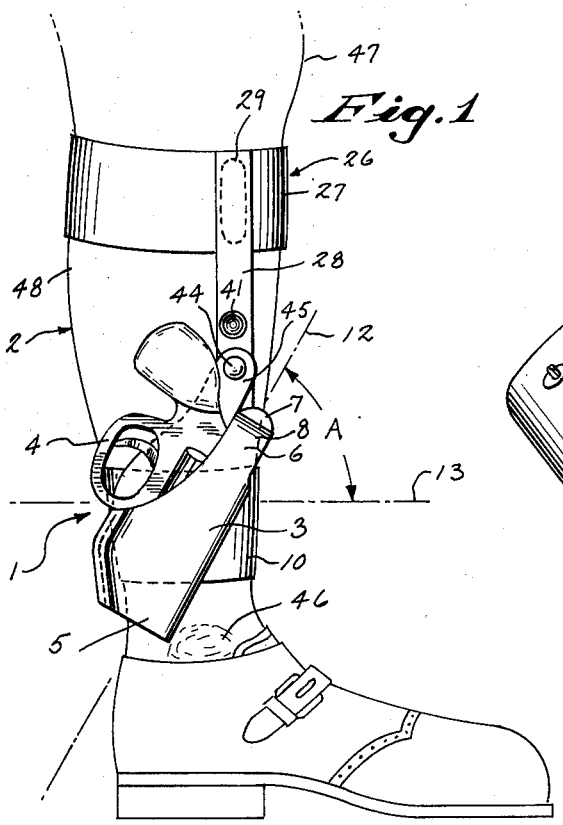
FIG. 1 is a side elevational view of a hand gun securing apparatus applied to a human leg.
Figure 2:
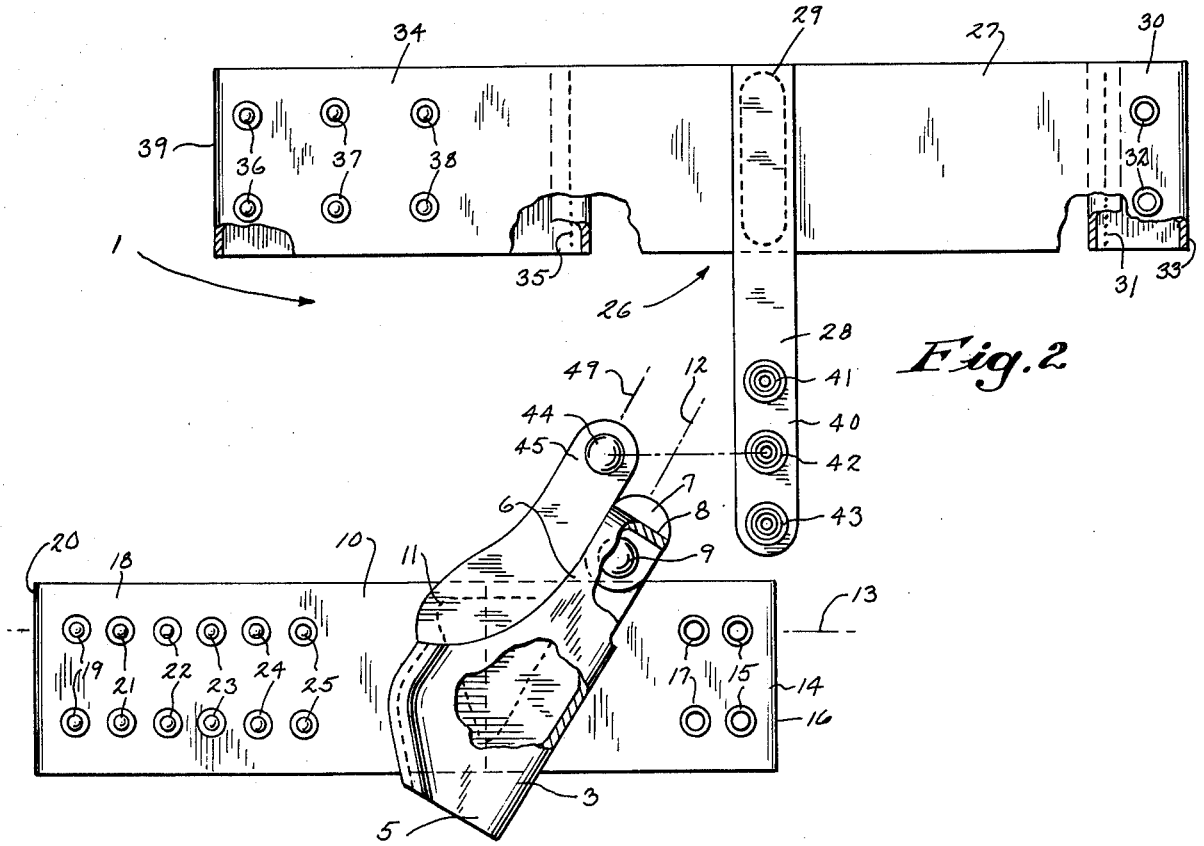
FIG. 2 is an exploded and developed view of the hand gun securing apparatus of FIG. 1.

Referring to the drawing and particularly FIGS. 1 and 2, a hand gun securing assembly 1 is connected to a human leg 2 so that a hand gun can be comfortably carried and concealed by a trouser leg and possibly a sock. The gun carrying assembly 1 includes a holster 3 which provides an opening for carrying a gun illustrated in phantom at 4. The illustrated holster 3 provides a lower portion 5 for receiving the gun muzzle and an upper portion 6 having a pair of tabs 7 and 8 which are releasably connected to each other by a snap 9 to secure and retain the gun 4 within the holster 3.

The holster 3 is connected to a leg encircling member 10 by a plurality of threads or stitches 11. The leg incircling member or belt 10 is preferably made of corset elastic which is folded upon itself and has elasticity in the longitudinal direction although a member made from woven fibers, leather, synthetic materials or the like could also be utilized within applicant's invention. The holster 3 is fixedly connected to the leg encircling member 10 so that a longitudinal axis 12 of the holster 3 is at an acute angle A with respect to a plane 13 formed by the leg encircling member 10.

The leg encircling member 10 provides a first end 14 containing a first pair of spaced snaps 15 located adjacent to and spaced from an outer edge 16 and a second pair of spaced snaps 17 located adjacent to and spaced from the pair of snaps 15. The member or belt 10 further provides a second end 18 containing a first pair of spaced snaps 19 located adjacent to and spaced from an edge 20. In addition, a series of spaced snaps numbered 21 through 25 are located between the spaced snaps 19 and the holster 3 with each pair spaced snaps at a different distance from the snaps 19. Each of the snaps 15 and 17 provide female receptacles which are adapted to releasably secure male type projections provided by the snaps 19 and 21 through 25. With the member 10 encircling the leg 2, the snaps 15 and 17 engage a selected two pair of adjacently located snaps 19 and 21 through 25 so that a varying adjustment for member 10 can be employed to fit varying sizes of legs.

A stabilizing member 26 includes a leg encircling member 27 which is fixedly connected to a laterally extending member 28 by a plurality of threads or stitches 29. The member or belt 27 preferably constitutes the same material as member 10 and includes a first end 30 where the material is folded upon itself and stitched at 31 to secure a pair of spaced snaps 32 located adjacent to the outer end 33. A second end 34 of the member 27 is also folded upon itself and stitched at 35 to secure three spaced pairs of spaced snaps 36, 37 and 38. The pair of snaps 36 are located adjacent to an outer end 39 while the pairs of snaps 37 and 38 are spaced inwardly therefrom at different distances and located between the snaps 36 and the stitching 35. The pair of snaps 32 each contain a female receptacle adapted to removably secure a corresponding male type projection provided by the snaps 36, 37 and 38.

The laterally extending member 28 provides an outer portion 40 which extends perpendicularly from the leg encircling member 27 and provides three spaced snaps 41, 42 and 43 therein. The snaps 41 through 43 contain male type projections which are adapted to be removably secured within a female type receptacle provided by a snap 44 which is fixedly connected to an upwardly extending portion 45 of the holster 3.

The hand gun securing assembly 1 is preferably connected to the lower portion of a human leg 2. Specifically, the leg encircling member 10 is located slightly above an ankle bone 46 so that the end portion 5 of holster 3 is located slightly to the rear of bone 46. The leg encircling member 27 is preferably located slightly below a knee bone 47 and at or slightly above a calf 48.

The stabilizing member 26 is effective for adjustably securing the holster 3 so that the hand gun 4 is prevented from bouncing or otherwise moving in an uncontrolled manner to thereby uncomfortably dig into the leg 2 and possibly be detected by an observer. With the leg encircling member 27 located at or above the calf 48, the stabilizing member 26 insures that the holster will not slip downwardly and rub or irritate the ankle or foot of the wearer.

One of the plurality of snaps 41 through 43 is selectively and releasably engaged by the snap 44 to provide the proper distance between the two leg encircling members 10 and 27 to ensure that the holster 3 is properly positioned. The use of the plurality of snaps 41 through 43 permits easy adjustment so that the hand gun securing assembly can be comfortably worn by users of different size. The releasable connection provided by the use of only a single snap 44 with the snaps 41 through 43 permits the stabilizing member 26 to slightly rotate with respect to the holster 3. The pivotal response provided by the snap 44 adds to the comfort of the wearer when actively exercising such as running but yet is effective to retain the holster 3 in a secured and desirable position at all times.

The pair of snaps 32 on the leg encircling member 27 are selectively and releasably coupled to one of the pairs of snaps 36 through 38. The use of a plurality of pairs of snaps permits adjustment of the member or belt 27 by the wearer to apply a comfortable and proper compression to retain the elastic member 27 at or slightly above the calf 48 at all times and yet not provide a serious obstruction to the blood flow within the wearer's leg 2.

In like manner, the snaps 15 and 17 on the leg encircling member 10 are selectively and releasably coupled to the snaps 19 and 21 through 25 to permit a selective adjustment for applying the proper tension of the elastic belt 10 about the ankle slightly above the ankle bone 46. Applicant has found that the utilization of four snaps at 15 and 17 provides additional comfort for the wearer and eliminates the tendency of the releasable connections to turn or twist and irritate the wearer's ankle.

It is further noted that the upper extension 45 of the upper portion 6 of holster 3 is longitudinally aligned at 49 to be substantially parallel to the general longitudinal alignment 12 of the holsters 3.

In use, the hand gun securing assembly may be worn on either the inside or outside of the leg and, while not preferred, could also be worn on the front or back sides of the leg. The use of applicant's invention in the above described preferred location permits the hand gun to be cleverly concealed by placing a sock over the lower portion 5 of the holster 3 and by permitting the trouser leg to descend over the entire assembly. The preferred use of applicant's invention permits ready access for quick and fast removal of the hand gun from the securing assembly.

Figure 3:
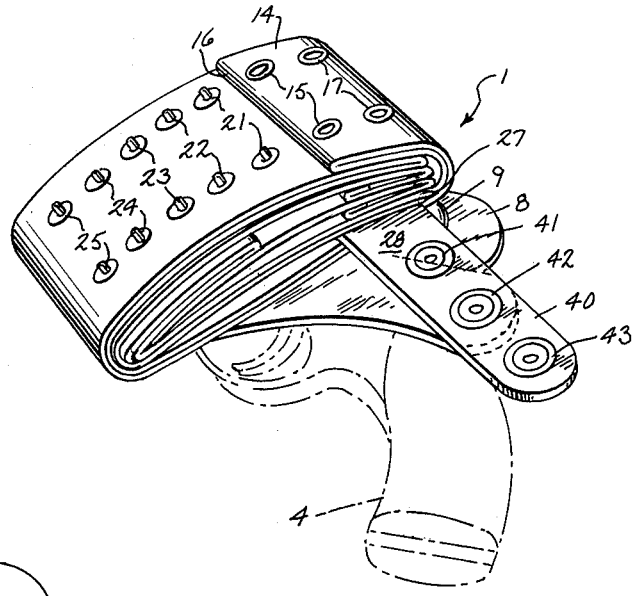
FIG. 3 is a perspective view of the hand gun securing apparatus in a collapsed position.

The pivotal connection provided by the releasable engagement of the snap 44 with one of the selected snaps 41 through 43 provides an additional advantage of permitting the hand gun securing assembly to be folded when not in use as shown in FIG. 3. In order to obtain such a compact assembly, the leg encircling member 27 is removed from the leg by releasing the snaps 32 while the leg encircling member 10 is similarly removed by releasing the snaps 15 and 17. The stabilizing member 26 is thereafter pivoted about the snap 44 so that the leg encircling member 27 is disposed in overlapping engagement with the leg encircling member 10. The pair of overlapping members 10 and 27 are thereafter folded into a compact assembly as illustrated in FIG. 3 with the outer snaps 15 releasably connected to the pair of snaps 19 so that the hand gun securing assembly may be conveniently stored when not in use even when the gun 4 is secured therein.

Applicant thus provides a very desirable hand gun securing apparatus which can be securely and comfortably worn about the lower portion of a wearer's leg well hidden from view by observers and which may be also removed and stored in a compact and secured assembly.

Various modes of carrying out the invention are contemplated as being within the scope of the following claims particularly pointing out and distinctly claiming the subject matter which is regarded as the invention.

I claim:

1. An apparatus removably securing a hand gun to a human leg, comprising a holster having an opening and removably retaining a hand gun, a first leg encircling member selectively connected about said leg near an ankle bone and well below a calf and connected to said holster, a second leg encircling member selectively connected about said leg slightly below a knee cap and at or slightly above the calf and spaced substantially from said gun retaining opening, and a connector assembly including means connecting said first leg encircling member and said second leg encircling member and essentially eliminating bouncing of said holster and turning of said first leg encircling member through leg movement and securing and stabilizing said hand gun to said human leg.

2. The apparatus of claim 1, wherein said connector assembly provides a selectively releasable connection between said first and second leg encircling members.

3. The apparatus of claim 2, wherein said connector assembly includes a plurality of spaced latching elements for selective connection to adjustably vary the distance between said first and second leg encircling members.

4. The apparatus of claim 1, wherein said connector assembly provides pivotal movement between said first and second leg encircling members.

5. The apparatus of claim 1, wherein said connector assembly includes a laterally extending member fixedly connected to said second leg encircling member.

6. The apparatus of claim 1, wherein said first leg encircling member includes a first end having a first plurality of spaced latching elements and a second end having a second plurality of spaced latching elements selectively connected to certain pre-selected ones of said first latching elements.

7. The apparatus of claim 1, wherein said second leg encircling member includes a first end having a first plurality of spaced latching elements and a second end having a second plurality of spaced latching elements selectively connected to certain pre-selected ones of said first latching elements.

8. The apparatus of claim 1, wherein said holster includes a longitudinal axis orientated to form an acute angle with a plane formed by said first leg encircling member.

9. An apparatus removably securing a hand gun to a human leg, comprising a holster having an opening removably retaining a hand gun, a first leg encircling member connected to said holster to form an acute angle between a longitudinal axis of said holster and a plane formed by said first leg encircling member and selectively connected by a first releasable connector about said leg near an ankle bone and well below a calf, a stabilizing member including a second leg encircling member selectively connected by a second releasable connector about said leg slightly below a knee cap and at or slightly above the calf and having a downwardly extending member providing an outer end having a first latching element, and a second latching element connected to an upper portion of said holster and selectively connected to said first latching element and rotatably securing said stabilizing member to said holster.

10. The apparatus of claim 9, wherein said first releasable connector of first leg encircling member includes first and second ends with said first end having at least four latching elements which selectively engage four latching elements located on said second end.

11. The apparatus of claim 1, wherein said connector assembly includes a first extension connected to said first leg encircling member and a second extension connected to said second leg encircling member and a pivotal connector joining said first and second extensions and operating with said apparatus removed from said leg and permitting rotation between said first and second extensions and selective overlapping engagement between said first and second leg encircling members with said leg encircling members being folded into a compact assembly.

12. The apparatus of claim 9, wherein said first and second latching elements form a snap permitting pivotal movement between said downwardly extending member and said upper portion of said holster and selective overlapping engagement between said first and second leg encircling members when removed from said leg with said leg encircling members being folded into a compact assembly and secured by said first releasable connector.

13. An apparatus removably securing a hand gun to a human leg, comprising a holster having an opening removably retaining a hand gun, a first leg encircling elastic belt fixedly connected to said holster to form an acute angle between a longitudinal axis of said holster and a plane formed by said first belt and having a first end providing a first series of spaced female type snap receptacles and a second end providing a first series of spaced male type snap projections selectively engaging said first female receptacles and surrounding said leg near an ankle bone and well below a calf, a second leg encircling elastic belt having a first end providing a second series of spaced female type snap receptacles and a second end providing a second series of spaced male type snap projections selectively engaging said second female receptacles and surrounding said leg slightly below a knee cap and at or slightly above the calf, and stabilizing means operatively coupling said first and second elastic belts and eliminating bouncing of said holster through leg movement and securing and stabilizing said hand gun to said human leg, said stabilizing means including an upwardly directed tab provided by said holster containing a third female type receptacle and a downwardly extending member rigidly connected to said second belt and providing a lower end having a third series of spaced male type snap projections one of which selectively and removably engages said third female receptacle providing a pivotal connection and permitting pivotal movement between said upward tab and said downward member and selective overlapping engagement between said first and second belts when removed from said leg with said first and second elastic belts being folded into a compact assembly and secured by selective engagement between at least one of said first receptacle and projections.

* * * * *